United States Patent [19]

Blevins et al.

[11] 4,410,329

[45] Oct. 18, 1983

[54] WASHING MACHINE WITH OVERSUDS DETECTION AND CORRECTION CAPABILITY

[75] Inventors: Theodore J. Blevins, Georgetown; Gerald L. Roberts, Louisville; Robert K. Hollenbeck, Louisville; Jimmy R. Rickard, Louisville, all of Ky.

[73] Assignee: General Electric Company, Louisville, Ky.

[21] Appl. No.: 318,712

[22] Filed: Nov. 6, 1981

[51] Int. Cl.[3] ..... D06F 33/02; D06F 39/06

[52] U.S. Cl. ..... 8/158; 68/12 R; 68/207

[58] Field of Search ..... 68/207, 205 R, 23.5, 68/12 R; 8/158

[56] References Cited

U.S. PATENT DOCUMENTS

| | | | |
|---|---|---|---|
| 2,425,378 | 8/1947 | Lindemann | 68/23.5 |
| 2,972,876 | 2/1967 | Geldhof | 68/18 |
| 3,197,979 | 8/1965 | Phillips et al. | 68/12 |
| 3,223,108 | 12/1965 | Martz, Jr. | 137/93 |
| 3,550,170 | 12/1970 | Davis | 8/158 |
| 3,570,272 | 3/1971 | Douglas | 68/12 |
| 3,610,001 | 10/1971 | Pellerin | 68/12 |
| 3,618,344 | 11/1971 | Hoffman | 68/23.5 |
| 3,645,669 | 2/1972 | Rausch | 8/137 |
| 3,674,419 | 7/1972 | Tichy | 68/12 R X |
| 3,742,736 | 7/1973 | Fish et al. | 62/23.5 |
| 3,914,107 | 10/1975 | Ellis | 8/158 |
| 4,091,833 | 5/1978 | Elis | 137/93 |
| 4,091,833 | 5/1978 | Ellis | 137/93 |
| 4,223,379 | 9/1980 | Simcoe | 364/104 |
| 4,237,565 | 12/1980 | Torita | 8/158 |

FOREIGN PATENT DOCUMENTS 2068419 8/1981 United Kingdom ..... 68/12 R

OTHER PUBLICATIONS

Application Serial No. 142,949, filed 4/23/80 for John Bochan.

Application Serial No. 203,208, filed 11/3/80 for Gerald Roberts.

*Primary Examiner*—Philip R. Coe.

*Assistant Examiner*—Thomas W. Epting

*Attorney, Agent, or Firm*—H. Neil Houser; Radford M. Reams

[57] ABSTRACT

An automatic clothes washing appliance of the type incorporating a stationary tub, a clothes receiving basket movably supported in the tub, a spray system for distributing fill water over the articles received in the basket, and a drive motor which selectively drives the basket for wash and spin cycle operation. The control system for the appliance includes an arrangement for detecting the existence of an oversuds condition in the tub and basket which is operative upon detection of an oversuds condition to interrupt appliance operation and initiate a corrective cycle which includes actuation of the spray system to spray water over the clothes in the basket. Upon completion of the corrective cycle, normal appliance operation is resumed from the point of interruption. In accordance with one aspect of the invention, the detection arrangement monitors motor speed to detect a change indicative of an increased load on the motor. The corrective cycle is initiated upon detection of a decrease in motor speed of a predetermined magnitude relative to an automatically adjusted reference speed.

13 Claims, 5 Drawing Figures

E
STOP ORBIT CLOCK
TURN OFF MOTOR
SET C = C+1
190
192
IS
C = 4
?
YES
NO
194
SET WATER
TEMP. REGISTER
TO COLD
GO TO
RINSE
CYCLE
196
SET T = 0
START TIMER T
TURN ON COLD
HI FLO WATER
198
IS
T = 1 MIN.
?
NO
YES
200
TURN OFF HI FLO
COLD
SET T = 0
202
IS
T = 4 MIN.
?
NO
YES
204
TURN ON MOTOR FOR
SPIN SET T = 0
206
IS
T = 30 SEC.
?
NO
YES
D
SET WATER
TEMP. REGISTER TO
COLD
210
IS
T = 7 SEC.
?
NO
YES
208
SET T = 0 TURN
MOTOR OFF

WASHING MACHINE WITH OVERSUDS DETECTION AND CORRECTION CAPABILITY

BACKGROUND OF THE INVENTION

The present invention relates to a washing machine of the vertical-axis type for the washing of fabric articles such as clothes, and more particularly to washing machines that have a system for detecting and correcting oversuds conditions during the wash cycle of operation.

Excessive suds build-up or oversudsing is a recognized problem for conventional agitator-type washing machines when operating in the spin mode. For orbital and horizontal axis tumbler-type washing machines the problem arises in both wash and spin operating modes. In order to achieve satisfactory washing results and to avoid excessive loading of the motor, a means for automatically detecting and correcting such conditions during the wash cycle is desirable. This need is particularly acute for orbital type machines such as, for example, that disclosed in U.S. Patent Application, Ser. No. 142,949, by John Bochan, filed Apr. 23, 1980 and now U.S. Pat. No. 4,328,600. In such machines, the rapid orbital motion of the basket within the tub subjects the air in the region between the bottom portion of the basket of the tub to a pumping action. When soapy liquid from the basket enters this region, it combines with the turbulent air to generate suds. When the detergent is sufficiently concentrated in this liquid from the basket, thick suds or foam build up rapidly to fill the tub and basket. In following its orbital path, the basket must shear and compress the foam between the tub and basket, placing a heavy and possibly excessive load on the motor.

U.S. Pat. No. 3,570,272 to Peyton W. Douglas discloses a system for suds lock elimination in agitator type machines. Suds locking as described by Douglas refers to the condition in which the detergent suds remain in the outside tub as water drains out, leaving a head of suds between the tub and the inner clothes basket. During spin the rotation of the inner basket churns the suds, causing the volume of suds to rapidly increase to the point of overflowing into the basket and possibly slowing down the basket. To eliminate the suds lock condition, Douglas proposes to spray the clothes and suds with water after the wash cycle is completed. Specifically, as taught by Douglas, the spin cycle is interrupted early in the cycle after the bulk of water has been removed but before excessive suds build up (approximately one minute). The motor is stopped by the timer for a brief pause (about 30 seconds) for deaeration of the suds. Spin of the basket is then re-initiated accompanied by water being sprayed over the clothes and suds for a predetermined period of one to two minutes to remove the suds from the machine. The timer then turns off the spray and spin continues to centrifugally remove the water from the clothes load. This basic sequence is automatically performed following every wash cycle whether or not excessive suds are actually present in the machine.

U.S. Pat. No. 4,091,833 to Ellis et al recognizes the problems of reduced efficiency of the washing action in a washing machine in the presence of excessive detergent foam which reduces the level of mechanical interengagement between materials being washed, as well as the inability of the washing solution to hold soiling matter in suspension when too little foam is present. In order to achieve the desired level of detergency in the machine, Ellis et al proposes a foam detecting system which monitors the electrical characteristics of the washing liquid to determine the amount of foam in the washing machine. The output signal from the foam detector is used to control the addition of detergent to provide a foaming condition corresponding to the desired detergency level. Specifically, Ellis et al teach actuating detergent dispensing valves to dispense detergent into the wash chabmer until the desired preselected foaming condition is achieved, then automatically closing the valves. Should the foaming condition subsequently fall below the desired condition, the system controls the admission of additional detergent to re-establish the desired condition.

While the Douglas patent and the Ellis et al patent deal with sudsing problems in washing machines, neither addresses the problem of automatically detecting and correcting oversuds conditions in a washing machine during the wash cycle.

It is therefore an object of the present invention to provide a washing machine employing means for detecting an oversuds condition in the washing machine during the wash cycle and means for interrupting normal wash cycle operation upon detection and initiating cyclical operation to correct such conditions before resuming normal cycle operation from the point of interruption.

SUMMARY OF THE INVENTION

Therefore, in accordance with the present invention there is provided a clothes washing machine of the type having a plurality of normal operating cycles including wash and spin cycles, which incorporates a stationary tub and a clothes receiving basket movably supported in the tub. Spray means is provided for distributing fill water over the clothing articles received in the basket. The spray means is coupled to an external water supply by fill valve means to control delivery of fill water from the external supply. Motor means selectively operative in a wash mode and a spin mode drives the basket for wash and spin cycle operations respectively. Drain pump means removes water from the tub. Control means for controlling the actuation of the various machine components, including the motor, valves and drain pump, provides the desired cyclical operation of the appliance. The control means further includes detection means to detect the existence of an oversuds condition in the tub and basket, and means responsive to the detection means operative upon detection of an oversuds condition to interrupt appliance operation, and initiate a corrective cycle which includes actuation of the fill valve means to spray water over the clothes in the basket. Upon completion of the corrective cycle, normal appliance operation is resumed from the point of interruption.

More specifically, in accordance with one aspect of the invention the detection means monitors an operating condition of the motor to detect a change indicative of an increased load on the motor. Upon detection of such a change, the control means deenergizes the motor and actuates the fill valve means for a first predetermined period to spray water over the clothes in the basket, thereafter pauses for a second predetermined period to allow the suds to break down and the clothes load in the basket to cool down, thereafter actuates the drain pump means to remove the water from the tub and thereafter resumes the appliance operating cycle from the point of interruption.

In accordance with that aspect of the invention illustratively embodied herein, the detection means monitors motor speed. The corrective action is initiated by the control means when the motor speed decreases by more than a predetermined amount relative to an automatically adjusted reference speed.

DETAILED DESCRIPTION OF THE ILLUSTRATIVE EMBODIMENT

Figure 1:
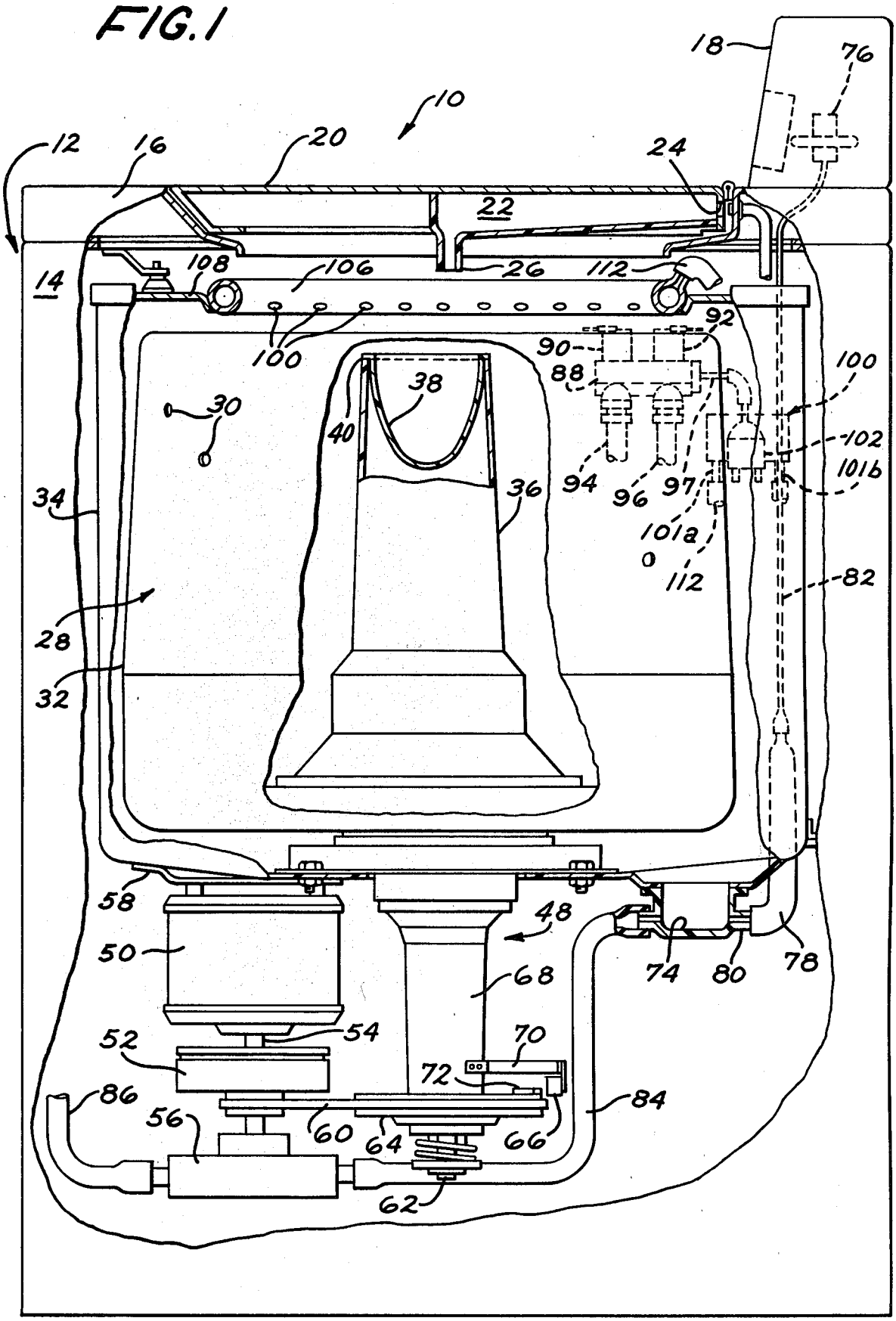
FIG. 1 is a side elevational view of a machine illustratively embodying one form of the present invention with portions removed to show various structural details thereof.

Referring now to FIG. 1, there is shown a washing machine 10 of the vertical axis type which includes a cabinet 12 having a base portion 14 and a top portion 16. Cabinet top 16 includes a control panel 18 normally provided with a plurality of switches and controls for user control of the operation of the machine. Cabinet top 16 is also provided with an access lid 20 hinged for movement between a closed position as shown and an open position permitting access to the interior of the washing machine. Lid 20 is provided with a water receiving trough or compartment 22 having a fluid inlet aperture 24 and a discharge spout 26.

A single perforate clothes receiving wash basket 28 having perforations 30 formed in its side wall 32 is disposed within an outer imperforate tub or casing 34. The basket 28 receives items such as fabric articles to be washed as well as the washing medium, usually water. Basket 32 includes a center post 36 with a cup-shaped receptacle 38 press-fitted thereto, the annular rim 40 of the receptacle 38 engaging the upwardly extending cylindrical wall of post 36. Receptacle 38 is adapted to receive and dispense detergent and/or other wash additives.

Basket 28 is driven by a transmission arrangement designated generally 48 and operated in response to operation of a reversible motor 50 through a system including a suitable load-limiting clutch 52 mounted on motor shaft 54. Shaft 54 also supports and drives a drain out pump 56 as is customary in the art. Motor 50 and the structure supported thereby are suitably mounted to tub 34 by mounting member 58. A suitable rotary drive belt 60 transmits power from clutch 52 to the input shaft 62 of transmission 48 through pulley 64. Depending upon the direction of motor rotation, pulley 64 and therefore input shaft 62 of transmission 48 is driven in opposite directions. When motor 50 is operated in its wash mode, it rotates shaft 62 in one direction offsetting the central basket axis laterally relative the axis of input shaft 62 and causing the central axis of basket 28 to orbit about the axis of input shaft 62 in a substantially horizontal plane. This orbital movement of basket 28 imparts a washing action to the clothing articles received within the basket. When motor 50 is operated in its spin mode, shaft 62 is rotated in the opposite direction. Transmission 48 aligns the axis of basket 28 with the axis of input shaft 62 and rotates the basket at a high speed substantially about its own axis for the centrifugal extraction of liquid from the clothing and from the basket.

Means for sensing the rate of rotation of transmission shaft 62 is provided in the form of a magnetically actuated reed switch 66 disposed adjacent pulley 64 and secured to transmission housing 68 by a mounting bracket 70. Magnet means in the form of a rectangular segment of magnetic material 72 is secured to pulley 64 for rotation therewith. Reed switch 66 is a normally open switch which is momentarily actuated or closed by magnet 72 upon each pass of magnet 72 past switch 66.

A sump 74 is secured in an opening of the bottom of tub 34 to receive washing liquid flowing from basket 28. Pump out pump 56 is connected to sump 74 by a hose 84 for withdrawing water from tub 34. Pump 56 is formed so that in either direction of motor rotation, pump 56 will draw liquid from sump 74 through hose 84 and discharge it through hose 86 to a suitable drain (not shown). The particular form of pump 56 is not significant so long as the pump withdraws liquid from the tub in response to motor rotation in either direction.

A water level switch 76, which may be of a type well known in the art, is mounted in control panel 18. An air chamber 78 is connected to nipple 80 of sump 74 and a hose 82 connects air chamber 78 to switch 76. As water accumulates in sump 74, the air in chamber 78 is compressed and switch 76 is closed. Closure of pressure switch 76 by water accumulating in sump 74 causes, among other actions to be discussed in more detail hereinafter, motor 50 to be energized thereby causing pump 56 to withdraw liquid from the sump when the amount of liquid received therein exceeds a predetermined amount.

Washing machine 10 is a fresh water flow through machine. The machine includes water supply means in the form of a solenoid operated mixer valve 88 (shown in phantom) having solenoids 90 and 92 coupled to sources of hot and cold water, respectively, such as household faucets by hoses 94 and 96, respectively. By selective energization of solenoids 90 and 92, hot, cold or warm water will be provided at the output pipe 97 of valve 88. The water from mixer valve 88 is fed through a conduit 98 to a solenoid diverter valve assembly 100 having a solenoid operated control valve 102 for controlling distribution of the water to basket 28 in a manner to be described hereinafter.

Spray means for distributing fill water substantially over the topmost layer of clothing articles received in basket 28 is provided in the form of a fill ring 106 which is secured to an annular mounting frame 108 which in turn is suitably to the upper extremity of tub 34. Fill ring 106 is a continuous hollow annular tube having a plurality of apertures 110 formed therein so that water will spray downwardly therefrom all around the inside of basket 28. Fill ring 106 is coupled to outlet port **101*a* of diverter valve assembly 100 by hose 112. When diverter valve 102 is de-energized or closed, all of the water entering assembly 100 is fed through hose 112. Water may also be delivered to basket 28 through trough 22 and spout 26 formed in lid 20. Hose 114 connects outlet port 101*b* of assembly 100 to a fluid nozzle 116 which is secured in an aperture formed in cabinet top 16**. Nozzle 116 is in juxtaposition to inlet aperture 24 formed in lid 20 to supply water to trough 22. Output from trough 22 is discharged from spout 26 into the dispensing receptacle 38 for mixing with the detergent, liquid or granules, which have been placed therein. When valve 102 is energized or open, flow from diverter valve assembly 100 is divided between hoses 112 and 114 in a predetermined ratio such as, for example, 4 to 1.

The structural details of the basket, transmission and suspension system for machine 10 are disclosed in greater detail in commonly-assigned, copending U.S. patent applications, Ser. No. 142,949, filed Apr. 23, 1980, and now U.S. Pat. No. 4,328,600, on behalf of John Bochan; and Ser. No. 203,208, filed Nov. 3, 1980, and now U.S. Pat. No. 4,329,859, by Gerald L. Roberts, the disclosures of which are hereby incorporated by reference.

A typical clothes washing operation proceeds as follows: The clothes to be washed are placed within the basket 28 and a desired amount of detergent is placed in receptacle 38. The user then chooses the appropriate cycle times and water temperatures for wash and rinse and turns on machine 10 by actuating the start switch. First, there is an initial wet down or soaking of the fabric articles in basket 28 by the flow of water from fill ring 106 without any flow of water from trough 22. This action thoroughly wets the clothes and prepares them for washing without using any detergent. When the clothes are thoroughly soaked, water will drain through perforations 30 to the bottom of tub 34 and into sump 74. When sufficient water collects in sump 74 pressure switch 76 is actuated causing motor 50 to be energized which in turn causes transmission 48 to move basket 28 in its orbital or washing mode. Closing of switch 76 also results in the energization of diverter valve 102 so that the flow of water is divided between ring 106 and trough 22. The water directed to the trough 22 flows from spout 26 into detergent receptacle 38 where it mixes with the detergent in receptacle 38. Due to the orbital motion of the basket, this relatively concentrated solution of water and detergent is ejected from receptacle 38 and mixes with the clothing.

Since the detergent is added gradually and since this flow through wash system retains only a relatively small amount of water in the machine at any one time, a very effective concentration of detergent is maintained in the wash water with an overall detergent usage substantially less than the prior art deep water bath machines.

At the conclusion of wash, there is a spin cycle in which there is a centrifugal extraction of wash water from the clothing in the basket. To accomplish this, the direction of rotation of motor 50 is reversed. This causes transmission 48 to align the axis of basket 28 with the main drive axis of input shaft 62 and to rotate basket 28 at high speed about this axis.

One consequence of the rapid orbital motion of the basket relative to the tub during wash cycles is that the air in the area between the basket and tub is subjected to a form of pumping action. As the wash cycle progresses, soapy wash liquid enters the tub beneath the basket. When subjected to the air turbulence resulting from the pumping action, this soapy liquid combines with the air to form a frothy mixture or foam of air and soapy liquid commonly known as suds. If the user adds substantially more detergent than needed for the amount of soil in the wash load, the detergent is not adequately neutralized by the soil. The detergent then may be sufficiently concentrated in the liquid passing from the basket to the tub to cause the build-up of suds to become excessive. In such a situation, thick suds similar in nature to shaving cream can fill up the tub and basket. As the volume of suds grows in the tub, the basket must both shear and compress the suds between the basket and tub to continue on its orbital path. In addition to hampering the proper washing action of the clothing articles in the basket which becomes clogged with suds, this additional load on the basket may result in damage to the motor and in extreme cases may cause structural damage to the machine. The present invention provides means for detecting the presence of an oversuds condition in a washing machine and taking corrective action before the suds have built up to undesirable levels.

As the suds begin to accumulate in the tub beyond desirable levels, the motor is subjected to an increase load. For normal medium size fabric loads on the order of 4–8 pounds, the motor wattage may increase from a normal level of 450–500 watts to 900–1100 watts. As the load on the motor increases, motor speed goes down and the power factor decreases. Thus various operating conditions of the motor are monitored during the wash cycle to detect excessive suds build-up.

Figure 2:
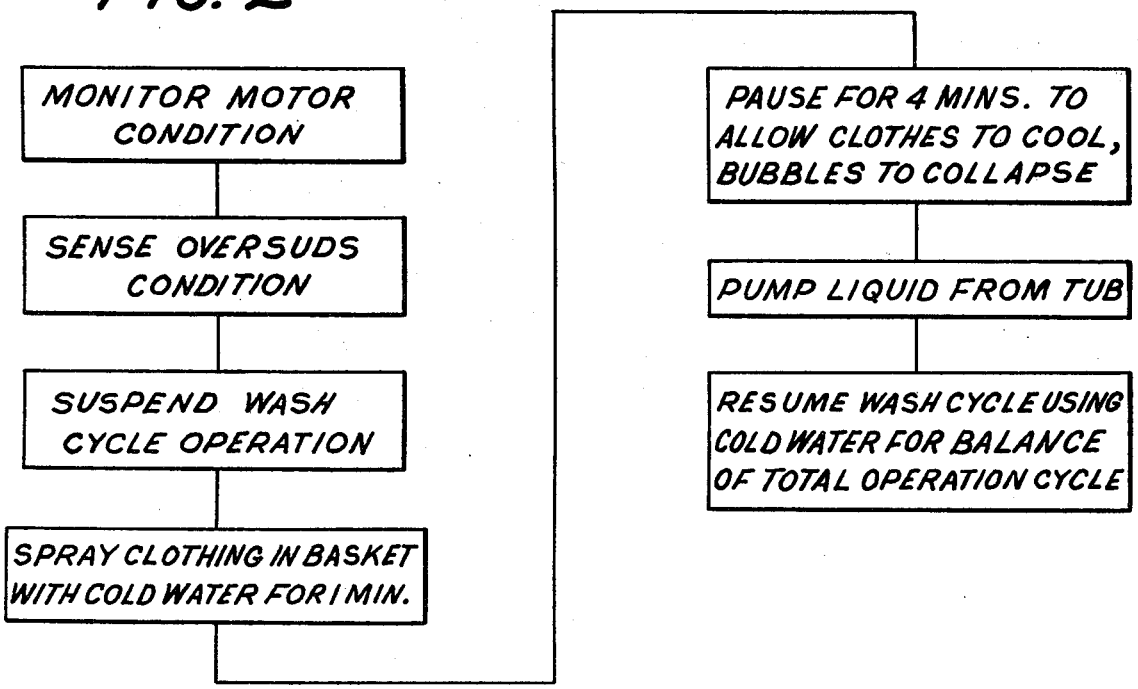
FIG. 2 is a block diagram illustrating the steps implemented by the control system of the washing machine of FIG. 1 to carry out a method in accordance with the present invention.

The steps comprising a method in accordance with one aspect of the invention for protecting against oversuds conditions are illustrated in FIG. 2. A motor condition such as speed or power factor is monitored for changes in the monitored parameter indicative of an oversuds condition. Upon sensing such a change, corrective action is initiated comprising the steps of stopping or suspending the wash cycle, spraying cold water over the clothes received in the basket for a first predetermined period, preferably one minute (at a fill rate of 3 gallons/minute), to break down the bubbles and cool the clothes, pausing for a second predetermined period, preferably four minutes, to allow the suds to continue to collapse as the load and basket cools, thereafter pumping the water, including broken down suds, from the tub and then resuming the interrupted wash cycle as before, limiting fill to cold water only for the balance of the operating cycle regardless of actual user water temperature selection.

In the form of the invention embodied in machine 10, the particular motor condition monitored is motor speed. The gear reduction effects of the drive belt arrangement, drivingly linking motor 50 with transmission shaft 62, provides essentially a 3:1 ratio of motor speed to transmission shaft speed. Thus, in the illustrative embodiment motor speed is sensed by sensing the rate of rotation or speed of the transmission shaft. Under normal operating conditions, motor 50 rotates at a nominal rate of 1800 rpm, driving transmission shaft 62 at a nominal rate of 600 rpm. The normal speed may vary from this nominal, depending in part at least upon the size of the clothes load. Thus, a reference rate or speed is automatically determined during each wash cycle for the particular load being washed. In the illustrative embodiment, the reference rate is determined by periodically sensing the transmission shaft speed and comparing this speed measurement, designated the present rate, to a previous measurement, designated the reference rate. The reference rate is periodically updated to reflect the maximum speed measurement detected for that operating cycle. Decreases in speed are thus measured relative to the maximum measurement. A decrease in measured speed from the maximum or reference rate which exceeds a predetermined limit, approximately 24 rpms in the illustrative embodiment, is symptomatic of an oversuds condition. When such a decrease is detected, the control system initiates corrective action.

Figure 3:
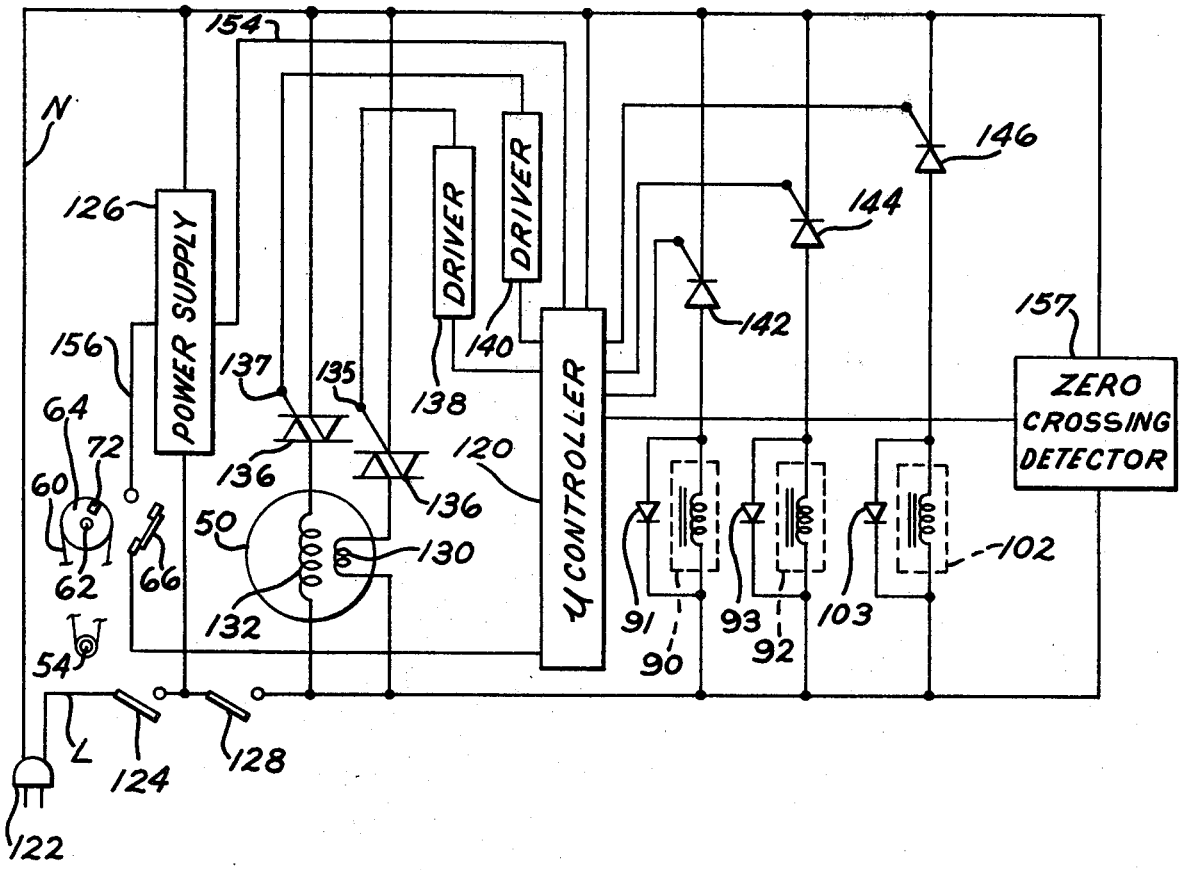
FIG. 3 is a simplified schematic circuit diagram of the control system of the washing machine of FIG. 1.

Referring now to FIG. 3, a washing machine control system for implementing the foregoing method of detecting and correcting oversuds conditions is shown in which a preprogrammed electronic controller 120 is employed to direct the functional operation of the various mechanical and electromechanical and electronic elements of washer 10. These various elements of washer 10 include output devices such as solenoids and solid state switching elements actuated by controller 120 and controller input devices in the form of mechanical switches. Additional input and output devices such as a keyboard input means and output display means have been deleted from the diagram for purposes of simplicity and clarity.

Electronic controller 120 is preferably a self-contained integrated circuit including an arithmatic logic unit, appropriate memory registers, and input and output circuits, as is well known in the art. In the illustrative embodiment, controller 120 is a readily commercially available single chip MOS microcontroller designated COP420L manufactured by National Semiconductor Corporation. This device is described in detail in National Semiconductor Publication entitled COP420L/421L and COP320L/COP321L Single Chip MOS Microcontrollers, copyright April 1980, which is hereby incorporated by reference.

In FIG. 3, power is provided through power plug 22 adapted to connect conductors L and N to a standard household electrical receptacle. Power is supplied to the appliance through user actuated ON/OFF switch 124 serially connected in conductor L. A conventional low voltage DC power supply 126 is connected across conductors L and N, to provide low voltage DC for the electronic controller 120. Lid-actuated switch 128 is connected serially in line L to prevent energization of various operating components in the circuit when the lid of the machine is opened.

Electric motor 50 is a single phase synchronous induction motor of the conventional type including a start winding 130 and a run winding 132. Start winding 130 is connected in series with triac 134 across conductors L and N. Similarly, run winding 132 is serially connected with triac 136 across conductors L and N. Triacs 134 and 136 are conventional thyristors capable of conducting current in either direction irrespective of the voltage polarity across their main terminals when triggered by gate signals of positive or negative polarity applied to the gate terminals 135 and 137, respectively. Energization of motor 50 and its direction of rotation are controlled by controller 120 which provides gating signals to triacs 134 and 136 through conventional amplifying driver circuits 138 and 140, respectively.

As previously described, motor 50 is a reversible motor arranged to rotate in one direction for wash and the opposite direction for spin. Motor direction may be determined by the timing of the gate signals to the start and run triacs. This manner of controlling motor operation is described in detail in copending, commonly-assigned patent application, Ser. No. 318,717, by Hollenbeck et al, the disclosure of which is hereby incorporated by reference.

Each of valve control solenoids 90, 92 and 102 are serially connected across conductor L and N through silicon controlled rectifiers (SCR) 142, 144 and 146, respectively. Diodes 91, 93 and 103 are connected in electrical parallel with solenoids 90, 92 and 102, respectively, to act as transient suppressors. Trigger or gate signals are applied to gate terminals 143, 145 and 147, of SCR's 142, 144 and 146, respectively, by controller 120 to actuate valves 90, 92 and 102, respectively.

Dc power supply 126 provides a low DC voltage for operation of microcontroller 120 through conductor 154. A pulsating DC voltage signal having a pulse repetition rate proportional to motor speed is provided to microprocessor 120 through magnetic reed switch 66 via conductor 156. As is represented schematically in FIG. 3, reed switch 66 responds to passage of magnet 72 carried by pulley 64 such that a pulse train is provided to microcontroller 120 on conductor having a pulse repetition rate proportional to the rate of rotation of transmission shaft 62.

A conventional zero crossing detector circuit 157 connected across conductors L and N provides the microcontroller with a synchronizing signal upon the occurrence of each zero crossing of the line voltage signal to enable controller 120 to synchronize operation with zero crossings of the power signal.

In accordance with one aspect of the invention, the detection means for detecting an oversuds condition in the tub and basket comprises means for sensing the rate of rotation of the transmission shaft 62 in the form of magnet 72 secured to pulley 64 for rotation therewith and magnetic reed switch 66 disposed adjacent pulley 64 for momentary actuation by magnet 72 upon each pass of magnet 72 such that the frequency of actuation is representative of the speed of motor 50. As shown schematically in FIG. 2, one side of switch 66 is connected to the power supply 126 and the other is connected to an input port of microcontroller 120. A pulsating measurement signal or pulse train is thus provided to microcontroller 120 having a pulse repetition rate or frequency proportional to the speed of motor 50.

The control means comprises electronic controller means responsive to the measurement signal including an appropriate programmed segment of microcontroller 120 operative to detect changes in the repetition rate and upon detection of a change in repetion rate of a predetermined magnitude indicative of an oversuds condition to deenergize motor 50, thereby interrupting normal cyclical operation and to actuate fill valve 92 for a first predetermined period causing fill water from the cold water supply to be distributed over the clothes in basket 28, thereafter to pause for a second predetermined period to allow suds breakdown and clothes load cool-down, thereafter to activate said pump means to remove water from the tub and thereafter to resume normal cyclical operation from the point of interruption.

In order to detect changes in rotation rate represented by changes in pulse repetition rate, an appropriately programmed segment of microcontroller 120 defines a recurring measurement interval of predetermined duration and increments an internal counter upon receipt of each pulse from switch 66 during the measurement interval. This counter is reset at the beginning of each interval; hence, the count at the end of the interval represents the rate of rotation of shaft 62 which is proportional to the speed of motor 50.

Shaft speed is monitored for decreases in speed indicative of an oversuds condition by comparing each new speed measurement to a reference measurement. If the new or present count exceeds the reference count, the present count is stored as the reference count and the old reference count is discarded. If the present count is less than the reference count, the old reference count is retained and the present count is discarded. When the reference count exceeds the present count by at least a predetermined threshold count, preferably 3 counts, corresponding to a drop in transmission shaft speed of 24 rpms, an oversuds condition is identified.

In the illustrative embodiment a duration of 7.5 seconds is selected for the measurement interval to provide the satisfactory measurement accuracy. The tolerance in the number of counts is +1 count. Each count corresponds roughly to 8 rpms/second. Thus, for the 7.5 second interval a shaft speed of 600 rpms corresponding to a motor speed of 1800 rpms would result in a count of 75. Thus, shaft speed can be measured with a tolerance of +8 rpms.

Figure 4:
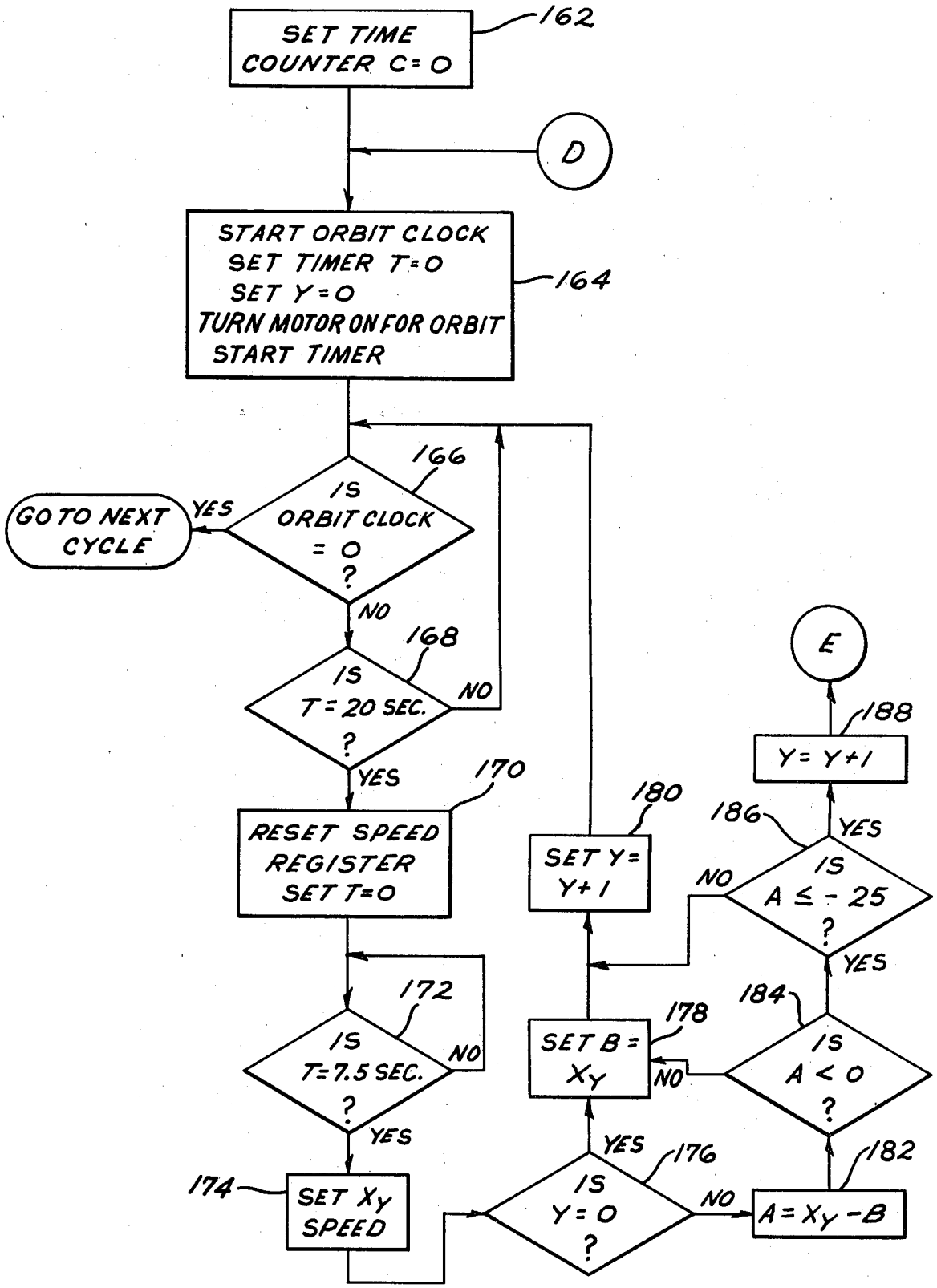
FIGS. 4 and 5 are program flow diagrams showing the manner in which the microcontroller of the control system of FIG. 3 can be programmed in accordance with the present invention.
Figure 5:
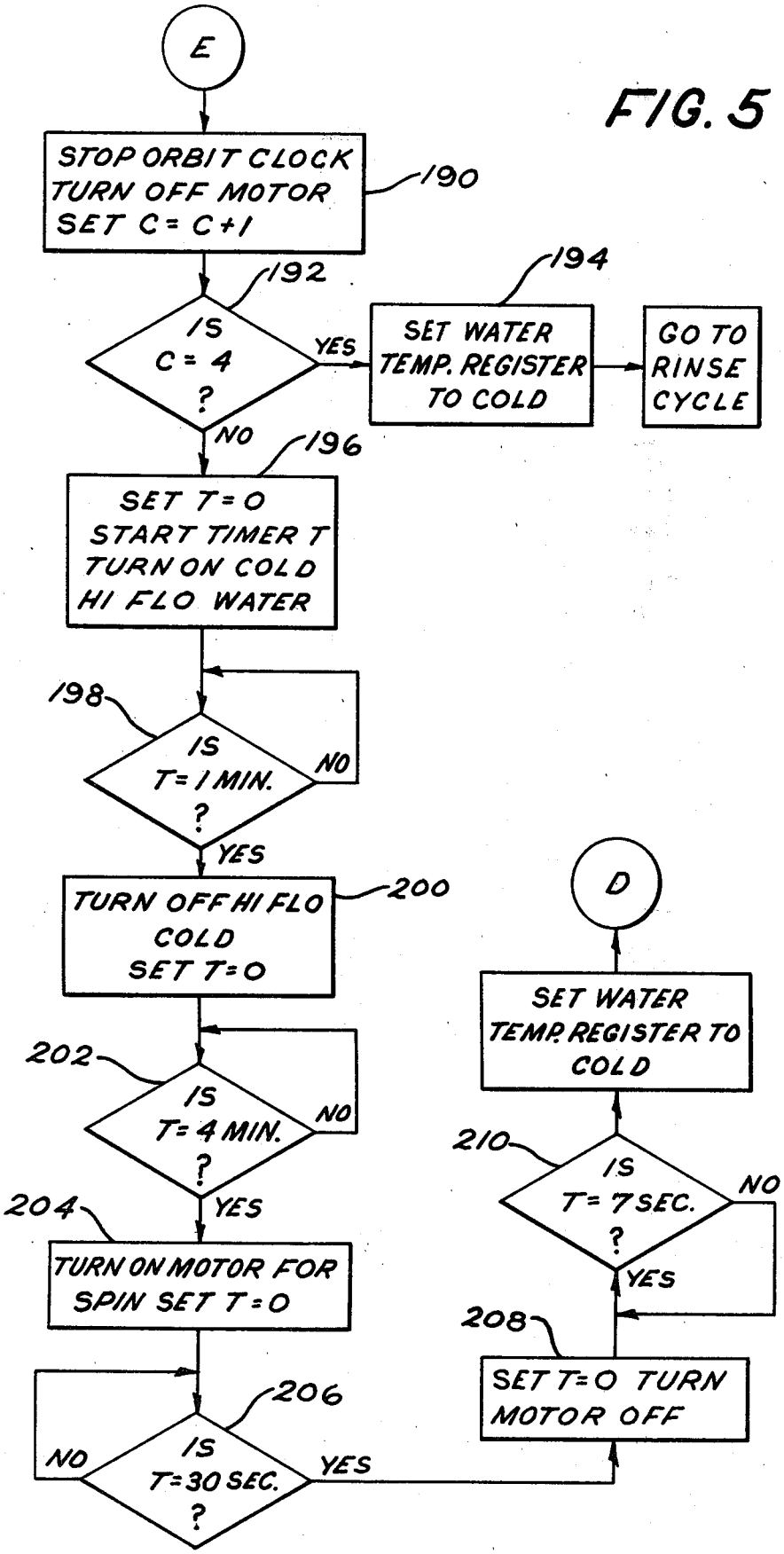

The Read Only Memory of microcontroller 120 is permanently configured to control operation of washing machine 10 in accordance with a predetermined set of instructions. In accordance with the present invention, the instruction set includes instructions for the detection of an excessive suds condition during the wash cycle and the implementation of corrective action described hereinbefore with reference to FIG. 2. FIGS. 4 and 5 are flow diagrams which illustrate that portion of the control routine implemented in microprocessor 120 which enables it to perform the detection and correction functions. From these diagrams, one of ordinary skill in the programming art can prepare a set of instructions for permanent storage in the Read Only Memory of microprocessor 120. It will be appreciated that the illustrated flow charts may represent only a portion of a complete program for microcontroller 120 by which other functions of the washing machine 10 are also controlled.

The excessive suds detection and correction instructions are represented for purpose of illustration as a detection subroutine depicted in the flow diagram of FIG. 4 and a correction subroutine depicted in the flow diagram of FIG. 5. It is to be understood that these instructions could be implemented as a self-contained subroutine or interleaved with instructions relating to other machine functions. In operation, the detection instructions direct microcontroller 120 to periodically determine present motor speed, compare the present speed to a previously measured reference motor speed; and branch to the correction instructions if the present speed has decreased from the reference speed by at least a predetermined amount.

Microcontroller 120 is programmed to provide various counters and registers used in executing the instructions represented in the flow diagrams of FIGS. 4 and 5, including a "TRY" counter, an Orbit Clock, a timer T, an index register designated Y, a Reference Speed Register, a Speed Counter, and a Water Temperature Register. The TRY counter is employed to limit the number of times the oversuds corrective cycle is implemented during any one wash cycle. The Orbit Clock is an internal clock which is initially set to the desired time duration for the orbit or wash mode of operation, i.e. the wash cycle. The duration for a particular cycle is determined by user cycle selection according to such factors as load size, type of fabrics in the load, and degree of soil. As the wash cycle progresses, the Orbit Clock is decremented in real time. When the Orbital Clock is decremented to zero, wash cycle ends and the controller proceeds to the next cycle, typically a rinse cycle. The timer designated simply T is a real time timer employed to control the duration of various time periods during the wash cycle. Register Y is an index register which is incremented after each speed measurement during execution of the program. The Speed Counter counts pulses from reed switch 66. The Reference Speed Register stores the reference speed count.

Referring now to FIG. 4, at the beginning of the wash cycle the TRY counter is initialized to zero (Block 162). Then the Orbit Clock is started, timer T is set to zero, index Y is set to zero, timer T is started and motor 50 is energized for operation in the wash mode by application of appropriate trigger signals to triacs 134 and 136 (Block 164).

Inquiry 166 terminates the wash cycle when the Orbit Clock times out. Inquiry 168 provides a 20 second delay before initiating a speed measurement. After 20 seconds, the speed counter is set to zero and timer T is reset to zero (Block 170). Inquiry 172 provides a 7.5 second delay which defines the speed measurement interval. During this interval, the speed counter is incremented upon receipt of each pulse from reed switch 66. At the conclusion of the speed measurement interval, the count of the speed counter representing the number of rotations of transmission shaft 62 during the interval which is proportional to motor speed is stored in memory as $X_Y$ (Block 174). Inquiry 176 causes the first speed measurement of the cycle or the first measurement following execution of the correction subroutine $X_Y$, either of which is identified by index Y=0, to be stored in memory as the reference speed measurement B (Block 178). Index Y is then incremented (Block 180) and the program returns to Block 166 to repeat the speed measurement steps. For each measurement for which Y=0, the program will progress from Block 176 to Block 182 which computes the difference between the current measurement $X_Y$ and the reference measurement B. Inquiry 184 determines whether the current measurement $X_Y$ is greater or equal to, or less than the reference B. If the current measurement equals or exceeds the reference speed (A 0) then the reference B is set equal to the current speed (Block 178), index Y is incremented (Block 180) and the program returns to Block 166 to take the next measurement. If inquiry 184 indicates that the current speed is less than the reference, then Block 178 is bypassed, the reference speed B remains the same and inquiry 186 determines whether the decrease in speed exceeds the predetermined threshold of 24 rotations per minute. 24 rotations per minute corresponds roughly to 3 rotations in the 7.5 second measurement interval. Thus, if A is less than zero but greater than 3, then the program merely increments Y and returns to obtain the next speed measurement. However, if A is less than or equal to 3, corresponding to a drop in speed of at least 24 rpms, then Y is incremented (Block 188) and the program branches to the oversuds correction instructions (FIG. 5).

When an oversuds condition is detected, the correction instructions implement the following steps: stops or suspends the orbit mode; showers the clothes with cold water for a first predetermined period; pauses for a second predetermined period for cool-down; removes the water from the tub, preferably with a brief spin cycle; stores a cold water instruction in the water temperature register; then returns to the detection instructions to resume the orbit mode. This corrective action may be repeated up to three times during each orbit mode or wash cycle. If an oversuds condition is detected a fourth time the orbit mode is aborted and the program branches to the next normal rinse cycle.

Referring now to FIG. 5, pursuant to the initial correction instruction, the Orbit Clock operation is halted but the Clock is not reset, motor 50 is de-energized and the "TRY" counter is incremented (Block 190).

Inquiry 192 limits the number of correction attempts per wash cycle by causing the program to branch to the next rinse cycle upon the fourth detection of an oversuds condition during any one wash cycle. Otherwise, timer T is reset to zero, and cold water is applied to the load via shower ring 106 by triggering SCR 144 to actuate cold water valve solenoid 92 (Block 196). Diverter valve is deenergized so that all the fill water enters via the shower ring. Inquiry 198 provides a one-minute fill period by delaying for one minute at Block 198 during which time approximately 3 gallons of fill water is provied to the basket. When T equals one minute, spray is terminated by deenergizing solenoid 92 and T is reset to zero (Block 200). Inquiry 202 provides a 4-minute delay to permit suds break down and cooling of the clothes load in the basket. After four minutes, motor 50 is energized for spin by appropriately triggering triacs 134 and 136 and T is reset to zero (Block 204). Inquiry 206 provides a 30-second delay while motor 50 operates in the spin mode centrifugally extracting water from the clothes and pumping water from the tub via drain pump 56. After 30 seconds, motor 50 is deenergized and timer T is reset to zero (Block 208). Inquiry 210 provides a 7-second delay to permit the basket to stop spinning. The program then returns to point D of FIG. 4 at which point the Orbital Clock is started and the wash cycle proceeds as before with continuing speed measurements until terminated by timing out of the Orbital Clock or until an oversuds condition is again detected, in which case another branch to the correction instructions occurs.

The water temperature register is normally set at the beginning of the operating cycle to reflect the wash water temperature selected by the user. However, when the normal wash cycle is interrupted to correct an excessive suds conditions, it is desirable once the condition has been corrected to resume the normal wash cycle with cold water, which is less conducive to sudsing, in order to reduce the likelihood of a recurrence of an oversuds condition during a cycle. Thus, before resuming the interrupted wash cycle, the contents of the water temperature register reflecting the user selection is replaced with the appropriate cold water temperature instruction so that for the balance of the wash cycle cold water is used, notwithstanding user water temperature selection.

It will be appreciated that there has been described herein an orbital type washing machine including a simple and effective oversuds detection and correction system. It should be understood, however, that while particularly advantageous in machines of the orbital type, this oversuds detection and control arrangement may also be applicable to the more conventional agitator-type washing machines. It is realized that numerous other modifications and changes will occur to those skilled in the art. It is therefore to be understood that the appended claims are intended to cover all such modifications as fall within the true spirit and scope of the invention.

What is claimed is:

1. A clothes washing appliance of the type having a plurality of normal operating cycles including wash and spin cycles, said appliance comprising:

a substantially stationary tub;

a clothes receiving basket movably supported in said tub;

spray means for distributing fill water substantially over the topmost layer of articles received in said basket;

fill valve means for controlling the delivery of fill water from an external supply to said spray means;

motor means selectively operative in a wash mode and a spin mode to provide wash and spin operating cycles, respectively;

pump means for removing water from said tub;

control means comprising means for detecting an oversuds condition in said tub and said basket, and means responsive to said detection means operative upon detection of said oversuds condition to interrupt the wash cycle and to actuate said fill valve means, thereby causing water to be distributed over the clothes in said basket by said spray means and thereafter to resume the wash cycle.

2. The clothes washing appliance of claim 1 wherein said control means comprises electronic controller means operative to control actuation of said fill valve means, said motor and said pump means; and wherein said detection means comprises sensing means operative to generate a measurement signal representative of an operating characteristic of said motor; and means responsive to said measurement signal operative to detect a change in said signal indicative of an oversuds condition and upon detection to deenergize said motor thereby interrupting normal cyclical operation and to actuate said fill valve means for a predetermined period causing fill water to be distributed over the clothes in said basket, thereafter to pause for a second predetermined period to allow suds break-down and load cool-down, thereafter to activate said pump means to remove water from the tub and thereafter to resume normal cyclical operation from the point of interruption.

3. The clothes washing appliance of claim 2 wherein said measurement signal has a pulse repetition rate proportional to the speed of said motor and wherein said change in said signal is a change in the pulse repetition rate.

4. The clothes washing machine of claim 3 wherein fill valve means comprises hot water control valve means and cold water control valve means and said microcontroller means is operative to actuate only said cold water valve means when actuating said fill valve means for the balance of the wash cycle following interruption of the wash cycle to correct an oversuds condition.

5. A clothes washing appliance of the type having a plurality of normal operating cycles including wash and spin cycles, said appliance comprising:

a substantially stationary tub;

a clothes receiving basket movably supported in said tub;

spray means for distributing fill water substantially over the topmost layer of articles received in said basket;

fill valve means for controlling the delivery of fill water from an external supply to said spray means;

motor means selectively operative in a wash mode and a spin mode to provide wash and spin operating cycles, respectively;

pump means driven by said motor means for removing water from said tub when said motor means operates in its spin mode;

control means comprising means for controlling the actuation of said fill valve means and said motor to provide the plurality of normal operating cycles, means for detecting an oversuds condition in said tub and said basket, and means responsive to said detection means, operative upon detection of an oversuds condition to deenergize said motor thereby interrupting the normal operating cycle, thereafter to actuate said water valve means for a first predetermined period causing fill water to be distributed over the clothes in said basket by said spray means, thereafter to pause for a second predetermined period, thereafter to energize said motor for operation in its spin mode for a third predetermined period, thereafter to resume the interrupted normal operating cycle.

6. A clothes washing appliance of the type having a plurality of normal operating cycles including wash and spin cycles, said appliance comprising:

a substantially stationary tub;

a clothes receiving basket movably supported in said tub;

spray means for distributing fill water substantially over the topmost layer of articles received in said basket;

fill valve means for controlling the delivery of fill water from an external supply to said spray means;

a motor for selectively driving said basket for wash and spin operations;

pump means for removing water from said tub;

control means comprising means for controlling the actuation of said fill valve means, said pump means and said motor to provide the plurality of normal operating cycles, means for detecting an oversuds condition in said tub and said basket, and means responsive to said detection means and operative upon detection of an oversuds condition to deenergize said motor thereby interrupting the normal operating cycle, thereafter to actuate said water valve means for a first predetermined period causing fill water to be distributed over the clothes in said basket by said spray means, thereafter to pause for a second predetermined period, thereafter to activate said pump means to remove fill water from said tub, and thereafter resume the interrupted normal operating cycle.

7. The clothes washing appliance of claim 5 or 6 wherein said detection means comprises means for monitoring an operating condition of said motor.

8. The clothes washing appliance of claim 7 wherein said basket is drivingly linked to said motor by transmission means including rotating transmission shaft means and wherein said sensing means comprises means for periodically sensing the rate of rotation of said transmission shaft means, and wherein said control means comprises means for comparing the present rate with a reference rate and operative to provide an oversuds signal signifying an oversuds condition when the present rate is less than the reference rate by at least a predetermined amount.

9. The clothes washing appliance of claim 8 wherein said control means updates said reference rate to equal the present rate whenever the present rate exceeds the reference rate.

10. The clothes washing appliance of claim 9 wherein said means for periodically sensing the rate of rotation of said transmission shaft comprises magnet means secured to said transmission shaft and magnetically actuated switch means disposed adjacent said transmission shaft for momentary actuation by said magnet means upon each pass of said magnet means, the frequency of actuation of said switch means being proportional to the speed of said motor.

11. The clothes washing appliance of claim 10 wherein said control means comprises a microcontroller including means electrically coupled to said switch means for repetitively counting the number of actuations of said switch means occurring during recurring measurement intervals of predetermined duration, said present count and said reference count corresponding to said present and reference rates, respectively.

12. A method for detecting and correcting an oversuds condition in an automatic washing appliance of the type having a plurality of normal operating cycles including wash and spin cycles, a stationary tub, a clothes receiving basket movably supported in the tub, spray means for distributing fill water substantially over the topmost layer of articles received in the basket, a motor selectively operative in a wash mode and a spin mode, pump means for removing water from the tub, and means for detecting an oversuds condition in the tub, the method comprising the steps of:

monitoring an operating condition of the motor;

detecting a change in the motor operating conditions indicative of an oversuds condition in the appliance;

deenergizing the motor, thereby interrupting the normal operating cycle; thereafter actuating the spray means to distribute fill water over the clothes in the basket for a first predetermined period; thereafter pausing for a second predetermined period to permit the clothes load in the basket to cool and the suds to break down; thereafter energizing the drain pump; and thereafter resuming normal wash cycle operation.

13. The method of claim 12 wherein the step of detecting a change in the motor operating characteristic comprises the steps of counting the rotations of the transmission drive shaft during recurring measurement intervals of predetermined duration, comparing the current count with a reference count representative of normal operation and detecting an oversuds condition when the reference count exceeds the current count by more than a predetermined amount.

* * * * *